US005570068A

United States Patent [19]

Quan

[11] Patent Number: 5,570,068

[45] Date of Patent: Oct. 29, 1996

[54] COAXIAL-TO-COPLANAR-WAVEGUIDE TRANSMISSION LINE CONNECTOR USING INTEGRATED SLABLINE TRANSITION

[75] Inventor: Clifton Quan, Arcadia, Calif.

[73] Assignee: Hughes Aircraft Company, Los Angeles, Calif.

[21] Appl. No.: 452,210

[22] Filed: May 26, 1995

[51] Int. Cl.[6] ..... H01P 5/08

[52] U.S. Cl. ..... 333/33; 333/260

[58] Field of Search ..... 333/33–35, 260; 439/63, 581, 582

[56] References Cited

U.S. PATENT DOCUMENTS

| | | | |
|---|---|---|---|
| 5,334,956 | 8/1994 | Leding et al. | 333/33 |
| 5,404,117 | 4/1995 | Walz | 333/34 |

OTHER PUBLICATIONS

"Handbook of Microwave Integrated Circuits," R. K. Hoffman, Artech House, pp. 86, 88; 1987.

"Semiconductor Control," Joseph F. White; Artech, pp. 516, 552.

*Primary Examiner*—Paul Gensler

*Attorney, Agent, or Firm*—Leonard A. Alkov; Wanda K. Denson-Low

[57] ABSTRACT

A coaxial-to-coplanar-waveguide connector that incorporates a slabline section within the coaxial connector interface between a circular-coaxial-transmission-line-to-coplanar-waveguide transmission line. As RF energy enters a circular coaxial input, the slabline section shapes the electromagnetic field distribution to more closely resemble that of coplanar waveguide at the output. The slabline section provides better field matching from the circular coaxial transmission line to the coplanar waveguide transmission line. Angular bends and lateral offsets can readily be incorporated in the connector.

15 Claims, 5 Drawing Sheets

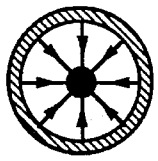
CONVENTIONAL COAXIAL LINE
FIG. 1A.
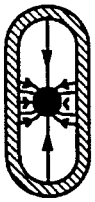
DIELECTRIC-FILLED SLABLINE
FIG. 1B.
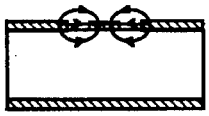
CPWG
FIG. 1C.
FIG. 2.
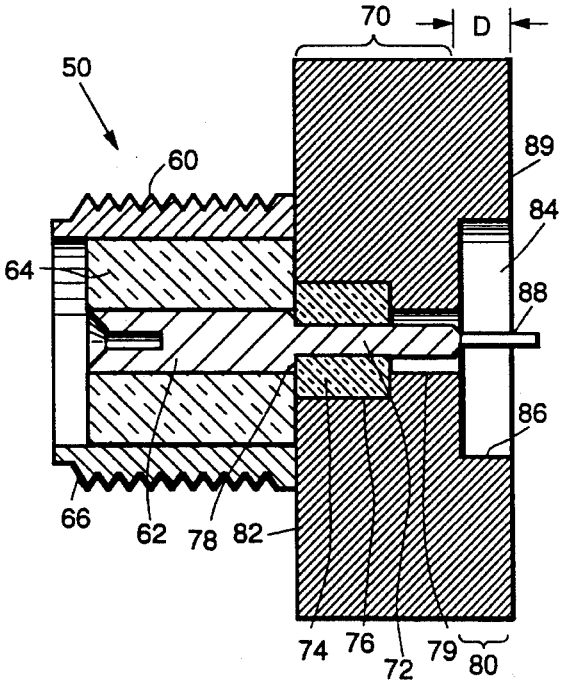
FIG. 3.
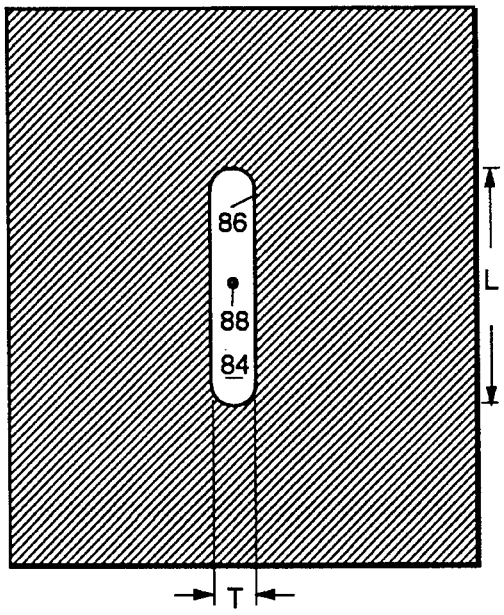

FIG. 9A.
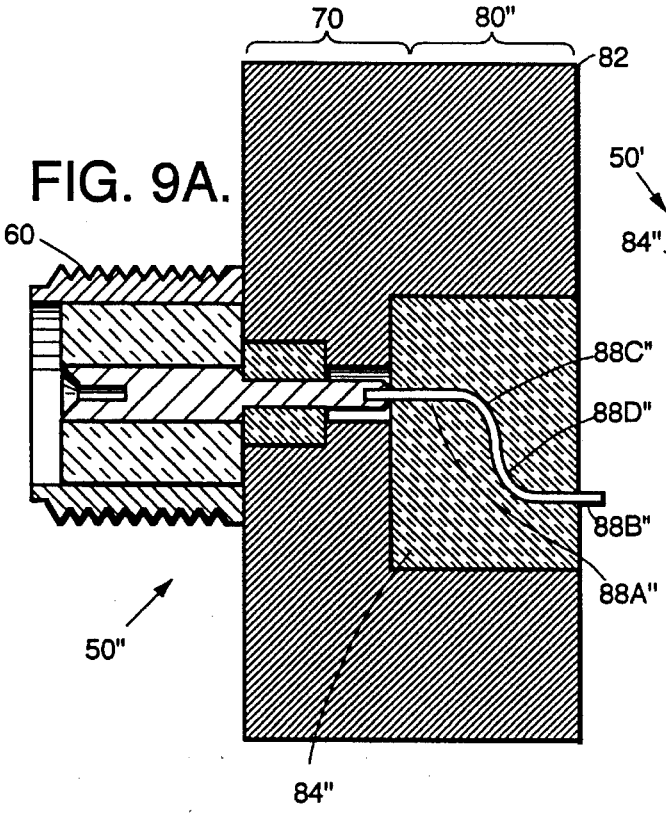
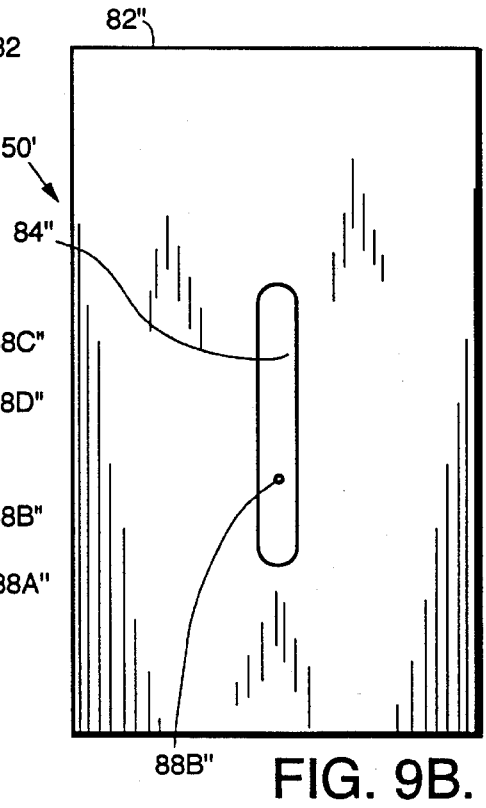
FIG. 9B.
FIG. 10.
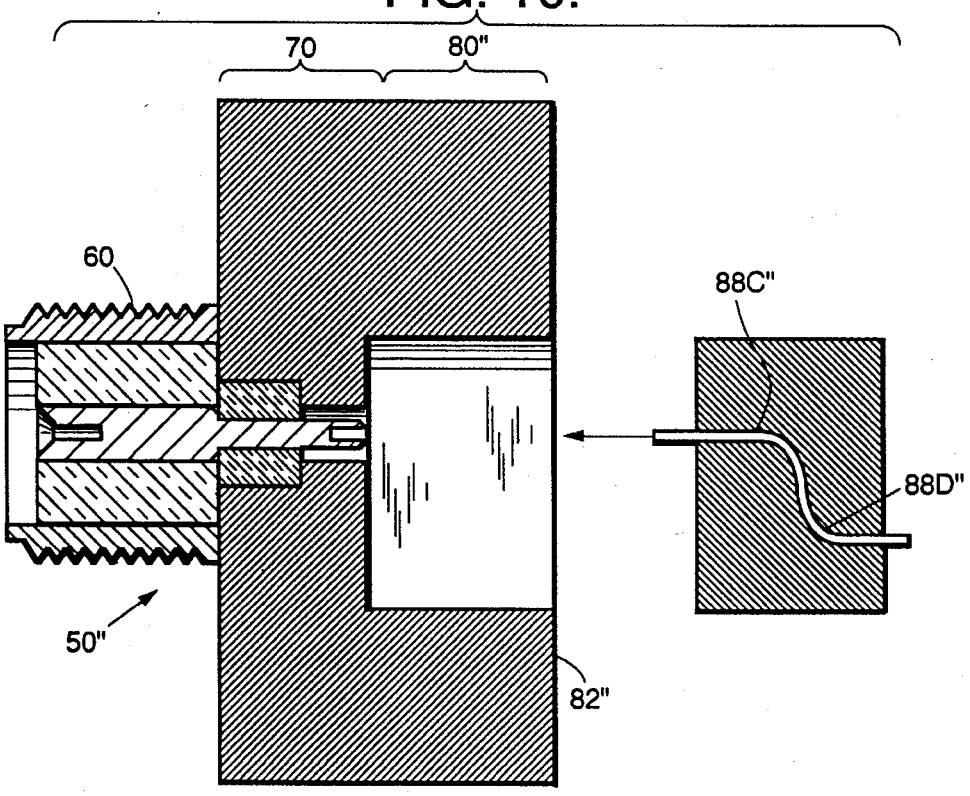

COAXIAL-TO-COPLANAR-WAVEGUIDE TRANSMISSION LINE CONNECTOR USING INTEGRATED SLABLINE TRANSITION

TECHNICAL FIELD OF THE INVENTION

This invention relates to the field of RF devices, and more particularly to a coaxial-to-coplanar-waveguide (CPW) connector that incorporates a slabline section within the coaxial connector to interface between the circular coaxial transmission line and the coplanar waveguide transmission line.

BACKGROUND OF THE INVENTION

Circular coaxial line is a well known type of transmission line suitable for signals at RF frequencies. Another type of well known type of transmission line is the coplanar waveguide (CPW) transmission line. In some applications, it is necessary to provide a transition between these two types of transmission lines.

The Handbook of Microwave Integrated Circuits, R. Hoffman, 1987, Artech House, pg. 88, describes a conventional coaxial-line-to-microstrip connector technique in which the circular coaxial line interfaces directly into coplanar waveguide (CPW). The performance of this connection is not optimum because the E field distribution of the CPW is concentrated along a line as opposed to radially across a plane. FIG. 1A shows the E field configuration of a conventional coaxial line. FIG. 1C shows the E field configuration of a coplanar waveguide. Any discontinuous field distribution in this conventional connector will result in degraded RF performance in terms of poor match and increased losses due to the generation of radiation and higher order waveguide modes.

SUMMARY OF THE INVENTION

An apparatus is described for transitioning between a circular coaxial transmission line and a coplanar waveguide (CPW) transmission line. The coaxial transmission line includes a center conductor, an outer conductive shield member and a dielectric spacing the center conductor from the outer shield member. The CPW line includes a center conductor strip and first and second ground plane conductors spaced from and sandwiching the center strip on a dielectric substrate. The apparatus comprises a coaxial connector interface apparatus for connection to the coaxial transmission line, the coaxial interface apparatus including a coaxial interface center conductor and an outer conductive shield spaced from the coaxial interface center conductor by a dielectric.

The apparatus further includes a slabline transmission line section comprising a slabline conductor suspended within an elongated dielectric-filled slabline cavity defined by a conductive slabline outer shield. The shield is electrically connected to the outer conductive shield of the coaxial interface apparatus. The slabline center conductor is aligned with and electrically connected to the coaxial interface center conductor. The cavity has a cross-sectional elongated dimension in a direction transverse to the CPW substrate and a cross-sectional narrow dimension in a direction aligned with a plane of the CPW substrate.

The apparatus further includes connection apparatus for electrically connecting the slabline conductor to the center CPW strip and for electrically connecting the slabline outer shield to the first and second ground plane conductor strips.

The invention provides an intermediate transmission line whose field distribution closely resembles both circular coax and CPW. This intermediate transmission line helps "smooth out" the discontinuity in the field distributions and its effects. Thus, the RF performance of the invention will be superior to what can be achieved with conventional connectors. Likewise, the RF performance of any microwave module package with CPW circuits using this invention will be superior to those using convention connectors.

BRIEF DESCRIPTION OF THE DRAWING

These and other features and advantages of the present invention will become more apparent from the following detailed description of an exemplary embodiment thereof, as illustrated in the accompanying drawings, in which:

FIG. 1A is a cross-sectional view of a circular coaxial line, showing the electric field configuration for this type of line. FIG. 1B is a cross-sectional view of a dielectric-filled slabline transmission line, showing the electric field configuration. FIG. 1C is a cross-sectional view of a coplanar waveguide transmission line, showing the electric field configuration.

FIG. 2 is a cross-sectional view of a coaxial-to-coplanar-waveguide connector employing an integrated slabline transition in accordance with the invention.

FIG. 3 is an end view of the connector of FIG. 2.

FIG. 9A is a cross-sectional view of a coaxial-to-coplanar-waveguide connector in accordance with the invention and including an integral slabline offset. FIG. 9B is an end view of the connector of FIG. 9A.

FIG. 10 is an exploded longitudinal cross-sectional view of the connector of FIG. 9A.

DETAILED DESCRIPTION OF THE PREFERRED EMBODIMENT

Figure 4:
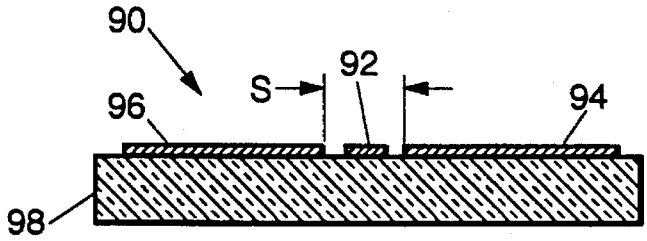
FIG. 4 is an end view illustrating coplanar waveguide and its characteristic dimensions.

The invention provides an improved connector transition for transitioning between circular coaxial line and coplanar waveguide (CPW). An intermediate transmission line is employed whose field distribution closely resembles the field distribution configuration of both circular coaxial transmission line and CPW. In the preferred embodiment, this intermediate transmission line is a modified slabline transmission line. Slabline is a type of transmission line having a round center conductor suspended between two parallel ground planes. See, e.g. "Semiconductor Control," J. White, Artech, page 516. The connector provides improved electrical performance in comparison to what has been achieved in conventional coaxial-to-CPW connector techniques. As an RF signal enters the circular coaxial input, the incorporated slabline transmission line section shapes the field distribution to more closely resemble that of CPW at the output.

FIG. 1B shows the electric field configuration of a dielectric-filled slabline. This intermediate transmission line helps "smooth out" the discontinuity in the field distributions between the field distributions of the circular coaxial line and the CPW, as can be seen from comparison with the respective electric field distributions shown in FIGS. 1A and 1C. Thus, the slabline section provides an improved field match from the circular coaxial transmission line to CPW transmission line than can be achieved with conventional connectors. Likewise the RF performance of any microwave module package with CPW circuits using this invention will be superior to those using conventional connectors using only circular coaxial line to interface directly into CPW.

FIG. 2 is a cross-sectional view of a connector apparatus 50 for transitioning between a circular coaxial line and a CPW transmission line. The apparatus 50 includes a male coaxial connector interface section 60 for connection to a female SMA coaxial connector. The apparatus 50 further includes a coaxial transition section 70, and a slabline section 80 which provides a transition from the connector interface section 60 to a CPW line (not shown in FIG. 2).

The coaxial interface section 60 includes a center conductor pin 62 disposed within a bore formed in a cylindrical dielectric member 64, formed in this embodiment of TEFLON™. The pin 62 has a diameter of 50 mils in this exemplary embodiment; the dielectric member 64 has a diameter of 0.160 inches. A threaded outer metallic shield 66 encloses the dielectric member 64, and is in electric contact with the metallic outer shield member 82 comprising the slabline section 80.

The apparatus 50 includes a coaxial transmission line transition section 70, for reducing the diameter of the conventional SMA center conductor pin 62 to be equal or less than the line width of the CPW center conductor of the CPW to which the transition is made. To minimize potential discontinuities, this coaxial size reduction may encompass multiple step reductions or a gradual taper depending on the allowable connector length. Each step reduction is chamfered to minimize potential discontinuities. The diameter of the corresponding outer conductor shield is also reduced to maintain a coaxial line characteristic impedance of 50 ohms. Thus, in the exemplary embodiment of FIG. 2, the section 70 includes a coaxial center conductor pin 72 having a diameter of 34 mils, disposed within a TEFLON dielectric member 74 having a diameter of 0.112 inches. The pin 62 is chamfered at 78 to transition to the smaller diameter pin 72. The dielectric member 74 in this embodiment is disposed within a bore 76 formed in the metallic outer shield member 82 having a length of 0.010 inch. The bore 76 then transitions to an air dielectric bore 79 of smaller diameter, 0.078 inch, having a length of 0.075 inch in this exemplary embodiment. The center conductor diameter remains constant through the bores 76 and 79. The dielectric material within the reduced sized coaxial line sections may be also selected to provide a dielectric constant to maintain the 50 ohms transmission line characteristic impedance.

The slabline section 80 includes a slabline outer metal shield 82 defining an elongated cavity 86 having a length L, a width T and depth D as shown in FIG. 2 and the end view of FIG. 3. In this embodiment, L=0.150 inch, T=0.056 inch and D=0.075 inch. The cavity is filled with a dielectric 84 such as REXOLITE™. The dielectric material is selected to provide a dielectric constant which will result in a slabline transmission line characteristic impedance of 50 ohms, i.e., to match that of the other sections of the connector 50. The width T is determined by approximating the ground plane spacing of the CPW line, as discussed below. The section 80 further includes a slabline center conductor pin 88 having a 20 mil diameter.

It is noted that the slabline section 80 approximates a slabline transmission line, since the dimension L is much larger than the dimension T.

The exemplary embodiment of FIG. 2 employs a coaxial line section 60 including a 0.050 inch diameter center conductor pin 62. This is reduced to 0.034 inch in the coaxial transition section 70, and finally to a 0.020 inch diameter within the slabline section 80. The coaxial outer shielding reduces from the initial 0.160 inch diameter in section 60 to a 0.112 inch diameter and finally to a 0.078 inch diameter just before entering the slabline section 80. The coaxial interface section 60 and part of the coaxial transition section 70 uses TEFLON™ ($\epsilon_r$=2.1) as the dielectric initially, and then air ($\epsilon_r$=1.0) just before entering the slabline section 80.

After the coaxial size reduction accomplished in the coaxial transition section 70, the outer conductor shield opening 86 is then elongated to reshape the electric fields into the slabline configuration. The narrow wall dimension T of the slabline outer shield opening 86 is adjusted to approximate the overall ground plane spacing S of the two outer CPW ground plane conductor strips 94 and 96, as shown in FIG. 4, for a CPW transmission line 90 comprising a center conductor strip 92 and dielectric substrate 98. The slabline cavity 86 is then filled with the appropriate dielectric material 84 to maintain 50 ohms. The embodiment of FIGS. 2 and 3 uses REXOLITE ($\epsilon_r$=2.6) as its dielectric filler to maintain 50 ohms for a 0.020 inch diameter pin and 0.056 inch narrow wall spacing.

Figure 5:
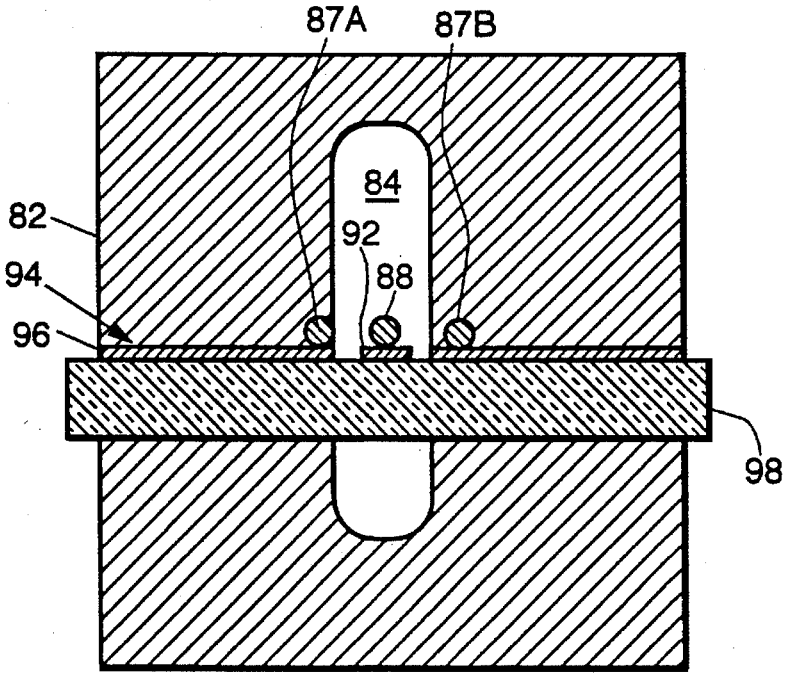
FIG. 5 is an end view of the connector of FIG. 2 with the coplanar waveguide in place relative to the connector.
Figure 6:
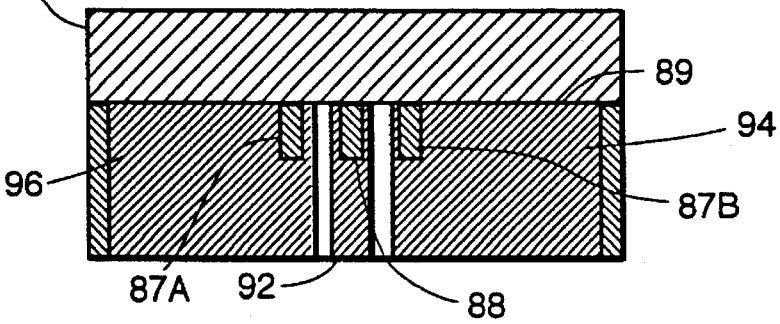
FIG. 6 is a top view of the end of the connector and coplanar waveguide of FIG. 5.

The assembled coaxial-slabline connector apparatus 50 is then attached to the CPW transmission line 90. As shown in the end and top views of FIGS. 5 and 6, the CPW center conductor strip 92 and outer ground plane conductors 94 and 96 are DC connected to the corresponding slabline center pin 88 and narrow wall surface 89 for the outer shield 82. This can be accomplished using conductive solders or epoxies, welded gold ribbons or wires, or pressure spring contact from pins or tabs extending from the connector onto the circuit board as shown in FIG. 6. Pins 87A and 87B protrude from the surface 89, and are electrically connected to strips 94 and 96, respectively.

Added features can be integrated to the slabline interface between the circular coax transmission line to coplanar waveguide transmission line that are difficult to incorporate in conventional connectors. These features include angular bends and lateral offsets. The dielectric used to fill the slabline transmission line cavity can be designed for hermetic sealing or for field replaceability.

Figure 7A:
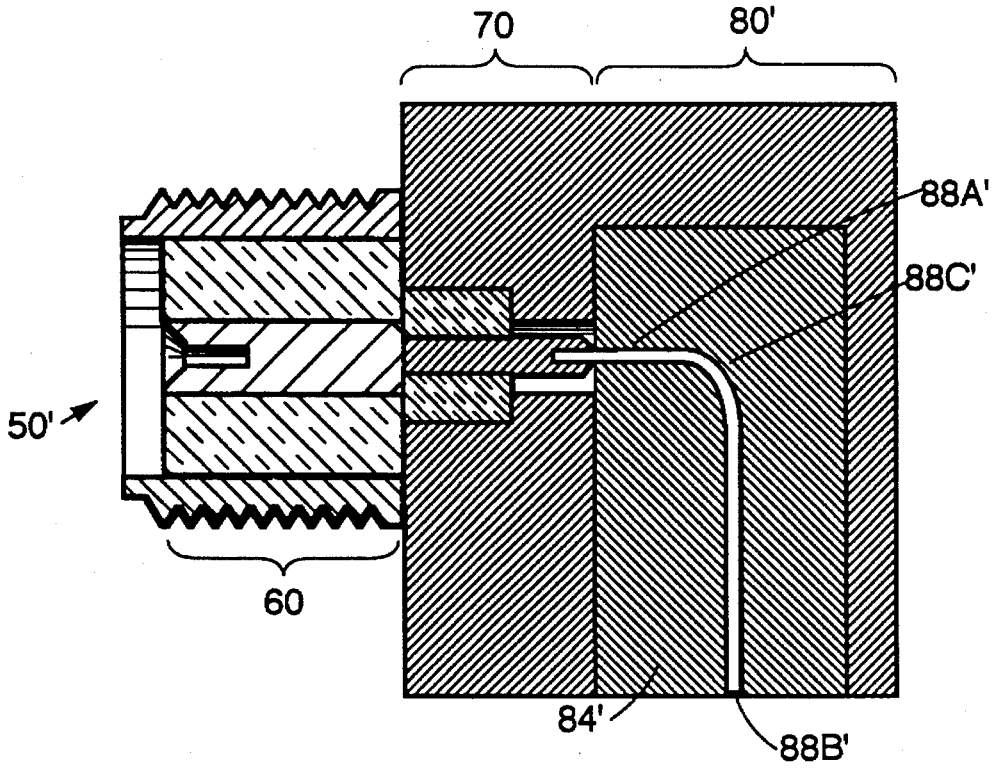
FIG. 7A is a top cross-sectional view of a coaxial-to-coplanar-waveguide connector in accordance with the invention and including an integral 90 degree slabline bend.
Figure 7B:
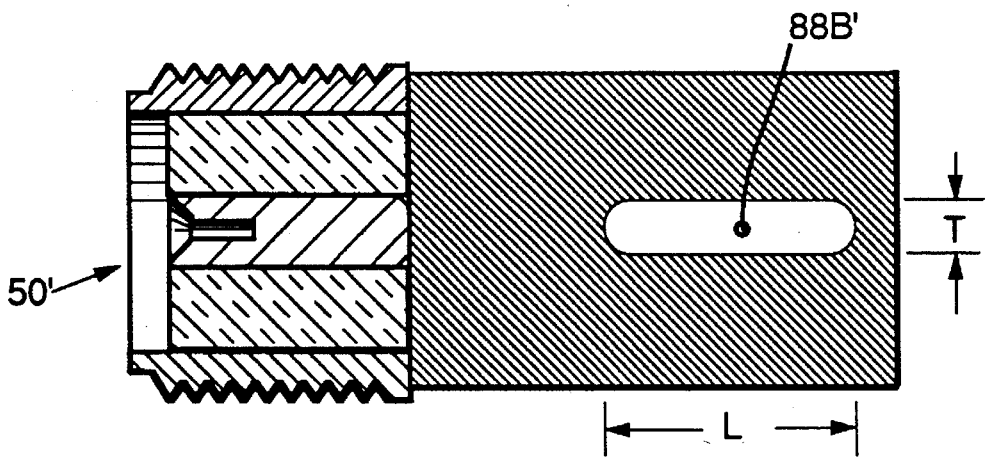
FIG. 7B is a front view of the connector of FIG. 7A.

FIGS. 7A and 7B show respectively cross-sectional and front views of an alternate embodiment of a connector apparatus 50' in accordance with the invention, employing an integral 90 degree slabline bend. The coaxial interface section 60 and coaxial transition section 70 of this embodiment 50' are identical to the corresponding sections of the apparatus 50 of FIGS. 2–3. The slabline section 80' includes an integral 90 degree bend. This is achieved as illustrated in FIG. 7B by orienting the long dimension L horizontally (i.e., orthogonal to the orientation of this dimension in the apparatus 50), and increasing the dimension D to accommodate the bend provided by the slabline center conductor sections 88A', 88B' and 88C'. The dielectric 84' can be added in sections to sandwich the center conductor sections and to fill the slabline cavity.

Figure 8A:
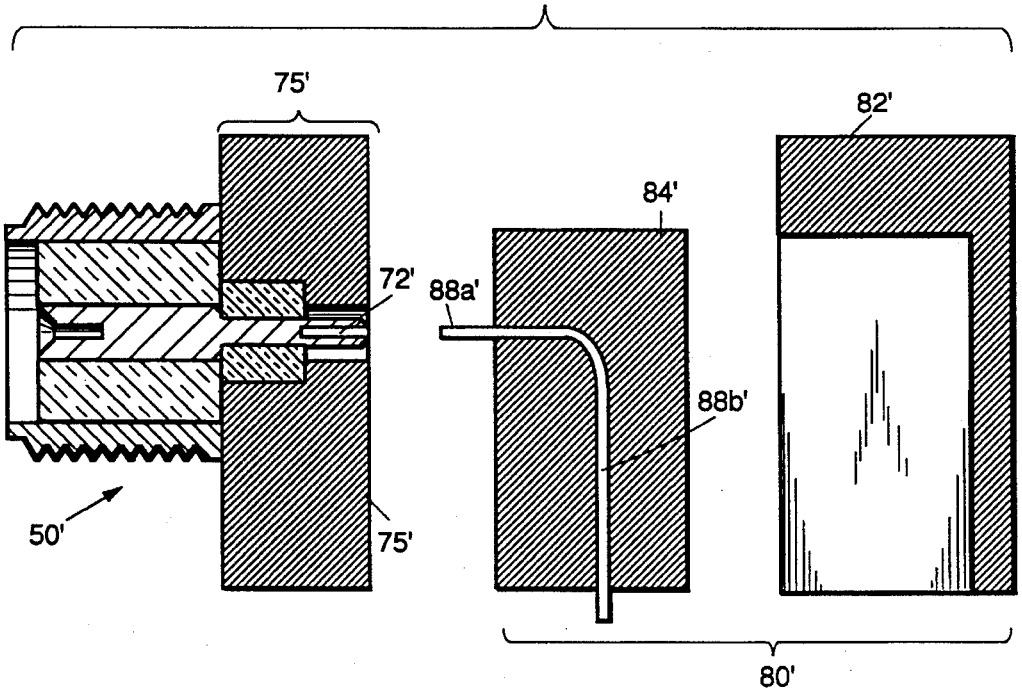
FIG. 8A is an exploded longitudinal horizontal cross-sectional view of the connector of FIG. 7A.
Figure 8B:
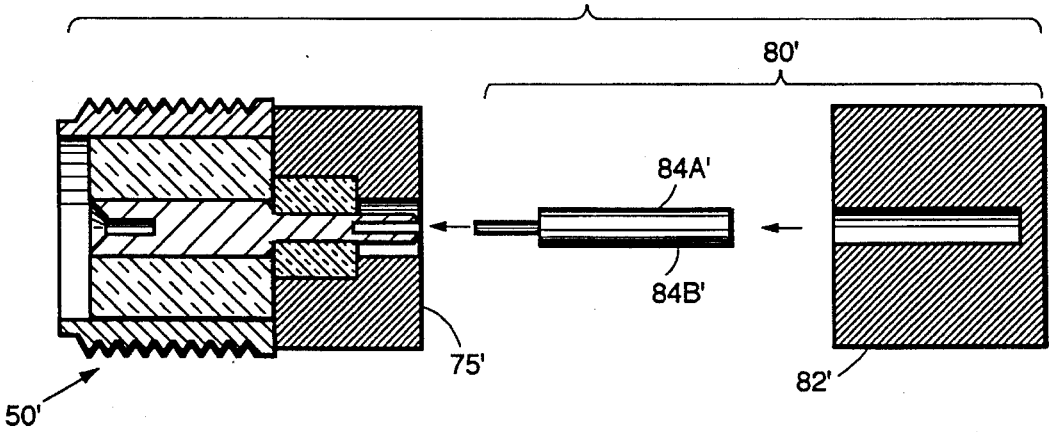
FIG. 8B is an exploded longitudinal vertical cross-sectional view of the connector of FIG. 7A.

FIGS. 8A and 8B are respective exploded views, taken from the top and side, of the connector 50', corresponding to the views shown in FIGS. 7A and 7B. In this exemplary embodiment, the center conductor 72' of the coaxial transition section 70' has a hollow split end to provide spring fingers which accept the exposed end of the slabline center conductor section 88A'. The slabline center conductor in this embodiment is a pre-bent wire center conductor with a radial H-plane bend in slabline to create a right angle bend connection with minimum reflections. The slabline center conductor is assembled or sandwiched between two slabs 84A' and 84B' (FIG. 8B) of dielectric material forming the dielectric 84'. Each slab has a groove formed therein in the proper contour of the center conductor. The exposed end of the slabline center conductor section 88B' is for attachment to the CPW center conductor strip.

The slabline dielectric 84' with the center conductor installed therein is then inserted into the cavity machined into the slabline outer conductor shield 82'. The shield with inserted dielectric and center conductor are disposed in contact with the coaxial outer shield member 75', and secured in place with fastening means such as screws, solder or conductive epoxy. The slabline shield surrounds and shields the slabline dielectric on four sides. One of the remaining two sides of the dielectric interfaces the air coaxial transmission line within the connector 50'. The exposed dielectric side interfaces the CPW transmission line.

FIGS. 9A and 9B are side cross-sectional and end views, showing a second alternate embodiment of a connector apparatus 50" which incorporates an integral slabline offset, to provide a connection between coaxial line and CPW line which are not in a collinear relationship. Here again, the coaxial interface section 60 and coaxial transition section 70 of this embodiment 50" are identical to the corresponding sections of the apparatus 50 of FIGS. 2–3. The slabline section 80" is modified from the section 80 of FIGS. 2–3 by increasing the dimensions L and D to accommodate an offset or jog defined by two 90 degree transitions 88C" and 88D" in the slabline center conductor. Thus, the slabline center conductor comprises two straight wire segments 88A" and 88B" and two 90 degree bend sections 88C" and 88D".

FIG. 10 is an exploded side cross-sectional view of the connector apparatus 50". In this embodiment, the slabline outer conductor shield 82" is integrated with the coaxial transition section outer shield, with the slabline cavity being formed using machining operations. The end of the coaxial center conductor is formed with split finger contacts to accept the slabline center conductor. The slabline center conductor in this example is a pre-bent wire sandwiched between two slabline dielectric sections, formed with grooves to accept the wire, and formed in the configuration of the slabline cavity. The pre-bent wire center conductor has two radial H-plane bends 88C" and 88D" to create a lateral offset with minimum reflections. The sandwich of the dielectric sections and the wire is then inserted into the cavity in the slabline outer shield, with the exposed inside end of the wire inserted into the spring finger contacts of the coaxial center conductor. The slabline outer conductor shield 82" surrounds and shields the dielectric on four sides. One of the remaining two sides interfaces the air coaxial transmission line at the coaxial transition section. The exposed dielectric side interfaces the CPW transmission line, in the same manner as illustrated in FIG. 5, except that there is a lateral offset between the respective axes of the coaxial line and the CPW line.

It is understood that the above-described embodiments are merely illustrative of the possible specific embodiments which may represent principles of the present invention. Other arrangements may readily be devised in accordance with these principles by those skilled in the art without departing from the scope and spirit of the invention.

What is claimed is:

1. Apparatus for transitioning between a circular coaxial transmission line and a coplanar waveguide (CPW) transmission line, the coaxial transmission line including a center conductor, an outer conductive shield member and a dielectric spacing the center conductor from the outer shield member, the CPW line including a center conductor strip and first and second ground plane conductors spaced from and sandwiching the center strip on a dielectric substrate, the apparatus comprising:

coaxial connector interface apparatus for connection to said coaxial transmission line, said coaxial interface apparatus including a coaxial interface center conductor and an outer conductive shield spaced from said coaxial interface center conductor by a dielectric;

a slabline transmission line section comprising a slabline conductor suspended within an elongated dielectric-filled slabline cavity defined by a conductive slabline outer shield, said shield electrically connected to said outer conductive shield of said coaxial interface apparatus, said slabline conductor in alignment with and electrically connected to said coaxial interface center conductor, said cavity having a cross-sectional elongated dimension in a direction transverse to said CPW substrate and a cross-sectional narrow dimension in a direction aligned with a plane of said CPW substrate; and connection apparatus for electrically connecting said slabline conductor to said center CPW strip and for electrically connecting said slabline outer shield to said first and second ground plane conductor strips, whereby said slabline transmission line section serves as an intermediate transmission line segment between said coaxial interface apparatus and said CPW line to shape the electric field distribution so as to provide a field transition between a coaxial line electric field distribution and a CPW line electric field distribution.

2. The apparatus of claim 1 wherein said first and second CPW ground plane conductor strips are separated by a separation distance, and said cross-sectional narrow dimension of said slabline cavity is substantially equal to said separation distance.

3. The apparatus of claim 1 further comprising a coaxial transition section for reducing a cross-sectional dimension of said coaxial interface center conductor from a diameter of said coaxial line to a diameter dimension substantially equal to a diameter of said slabline center conductor.

4. The apparatus of claim 3 wherein said coaxial transition section includes an outer shield having a cross-section dimension which is reduced in relation to a corresponding cross-section dimension of said outer shield of said coaxial connector interface to maintain a substantially constant characteristic impedance.

5. The apparatus of claim 3 wherein said coaxial transition section includes a center transition conductor having a reduced diameter in relation to a diameter of said coaxial interface center conductor.

6. The apparatus of claim 1 wherein said outer shield of said coaxial connector interface apparatus includes a threaded outer surface for threading engagement with a coaxial connector.

7. The apparatus of claim 1 wherein said slabline transmission line section includes a 90 degree slabline bend.

8. The apparatus of claim 1 wherein said slabline transmission line section includes a slabline center conductor offset.

9. Apparatus for transitioning between a circular coaxial transmission line and a coplanar waveguide (CPW) transmission line, the coaxial transmission line including a center conductor, an outer conductive shield member and a dielectric spacing the center conductor from the outer shield member, the CPW line including a center conductor strip and first and second ground plane conductors spaced from and sandwiching the center strip on a dielectric substrate, the apparatus comprising:

coaxial connector interface apparatus for connection to said coaxial transmission line, said coaxial interface apparatus including a coaxial interface center conductor and an outer conductive shield spaced from said coaxial interface center conductor by a dielectric;

a slabline transmission line section comprising a slabline conductor suspended within an elongated dielectric-filled slabline cavity defined by a conductive slabline outer shield, said shield electrically connected to said outer conductive shield of said coaxial interface apparatus, said slabline conductor in alignment with and electrically connected to said coaxial interface center conductor, said cavity having a cross-sectional elongated dimension in a direction transverse to said CPW substrate and a cross-sectional narrow dimension in a direction aligned with a plane of said CPW substrate;

coaxial transition section for reducing a cross-sectional dimension of said coaxial interface center conductor from a diameter of said coaxial line to a diameter dimension substantially equal to a diameter of said slabline center conductor; and connection apparatus for electrically connecting said slabline conductor to said center CPW strip and for electrically connecting said slabline outer shield to said first and second ground plane conductor strips, whereby said slabline transmission line section serves as an intermediate transmission line segment between said coaxial interface apparatus and said CPW line to shape the electric field distribution so as to provide a field transition between a coaxial line electric field distribution and a CPW line electric field distribution.

10. The apparatus of claim 9 wherein said first and second CPW ground plane conductor strips are separated by a separation distance, and said cross-sectional narrow dimension of said slabline cavity is substantially equal to said separation distance.

11. The apparatus of claim 9 wherein said coaxial transition section includes an outer shield having a cross-section dimension which is reduced in relation to a corresponding cross-section dimension of said outer shield of said coaxial connector interface to maintain a substantially constant characteristic impedance.

12. The apparatus of claim 9 wherein said coaxial transition section includes a center transition conductor having a reduced diameter in relation to a diameter of said coaxial interface center conductor.

13. The apparatus of claim 9 wherein said outer shield of said coaxial connector interface apparatus includes a threaded outer surface for threading engagement with a coaxial connector.

14. The apparatus of claim 9 wherein said slabline transmission line section includes a 90 degree slabline bend.

15. The apparatus of claim 9 wherein said slabline transmission line section includes a slabline center conductor offset.

* * * * *